United States Patent [19]

Frutin

[11] Patent Number: 4,556,156

[45] Date of Patent: Dec. 3, 1985

[54] PRESSURIZED DISPENSING APPARATUS

[75] Inventor: Bernard D. Frutin, Stewarton, Scotland

[73] Assignee: Rocep-Lusol Holdings Limited, Glasgow, Scotland

[21] Appl. No.: 509,440

[22] PCT Filed: Sep. 24, 1982

[86] PCT No.: PCT/GB82/00278

§ 371 Date: Jun. 1, 1983

§ 102(e) Date: Jun. 1, 1983

[87] PCT Pub. No.: WO83/01244

PCT Pub. Date: Apr. 14, 1983

[30] Foreign Application Priority Data

Oct. 6, 1981 [GB] United Kingdom ..... 8130127
Apr. 24, 1982 [GB] United Kingdom ..... 8211944

[51] Int. Cl.[4] ..... B67D 5/42

[52] U.S. Cl. ..... 222/386.5; 222/389; 222/327

[58] Field of Search ..... 222/389, 386, 386.5, 222/80, 147, 326, 327, 541

[56] References Cited

U.S. PATENT DOCUMENTS

| | | | |
|---|---|---|---|
| 2,649,995 | 8/1953 | Muskin | 222/386.5 |
| 3,273,762 | 7/1966 | O'Neill, Jr. | 222/389 |
| 3,430,731 | 3/1969 | Satzinger | 222/389 |
| 3,756,476 | 9/1973 | Bonduns | 222/386.5 |

FOREIGN PATENT DOCUMENTS

| | | | |
|---|---|---|---|
| 2015655 | 3/1979 | United Kingdom | 222/389 |

*Primary Examiner*—Joseph J. Rolla
*Assistant Examiner*—Kenneth Noland
*Attorney, Agent, or Firm*—Mason, Fenwick & Lawrence

[57] ABSTRACT

Apparatus for dispensing material under propellant pressure, particularly highly viscous material, includes a container having a piston therein, the material to be dispensed being located on one side of the piston and the propellant on the other. Penetration of propellant into the material to be dispensed is prevented by providing sealant which engages the container wall and slides with the piston, the sealant being of flowable material such as organic and mineral liquids and greases and mastics based on these or aqueous based gels and mastics.

11 Claims, 4 Drawing Figures

PRESSURIZED DISPENSING APPARATUS

This invention relates to a container adapted to dispense its contents under pressure. Particularly, but not exclusively, the invention is concerned with the dispensing of viscous materials from a container under pressure of a propellant.

A vast range of materials are routinely dispensed from pressurised containers of the commonly named "aerosol" type. In such containers the material to be dispensed ("the product") lies within the container either in admixture with or in solution in the propellant. This technology, therefore, is suitable only for dispensing products which do not interact with or deteriorate in the presence of the propellant. Also, such containers normally dispense the product as a fine mist but they can be adapted to dispense the product as an unbroken liquid stream.

A small number of special container designs are known for dispensing products which have to be held out of contact with the propellant. There are, generally speaking, two types of these containers, the "collapsible bag" type and the "piston" type. In the collapsible bag arrangement the product is held in a flexible bag secured to the neck of the container with an outlet valve extending outwards for exit of the product; the propellant is held between the bag and the container wall. Under pressure the bag collapses and extrudes the product from the exit valve. Problems with this arrangement are that the bags are permeable to the propellant causing bubbles to form in the product, and also the bags tend to collapse in an unpredictable manner and incompletely, which leaves amounts of the product trapped therein and unusable.

In the "piston" type the container is divided into two chambers by an internal piston, product is held on one side of the piston and propellant on the other. Under pressure of the propellant the piston forces the product from the container.

We have carried out much investigation over several years into the operation of the piston type of dispenser and the operational problems thereof. They are not common in the market-place; those which are available appear to satisfy their specific uses but one major problem prevents their unrestricted general application to products of any kind. That major problem is penetration of the propellant into the product. If the presence of the propellant deteriorates the product, and many materials are affected adversely then the known packs cannot be used. Even if the product is chemically inert to the propellant, the propellant may nevertheless from gas bubbles in the product and break up the extruded stream of product.

The present invention provides a piston type of dispenser which can be used for dispensing any material but its development was undertaken to dispense semi-solid mastics, adhesives and silicone sealants most of which are extremely sensitive to contact with the propellant.

Many mastics, sealants and adhesives are available commercially is small packages in squeeze-tube packs and in larger quantities in cylindrical tubes, one end of which is formed by a slidable piston. In use, a manually operable "skeleton gun" is supplied which clamps around the tube and by exerting pressure by a screw twist or by a trigger actuated pump action the piston is forced manually through the tubular container. The main difficulties with this arrangement are the cost of the gun and the difficulty of maintaining a constant manual pressure in order to extrude a stream of product of uniform dimensions while at the same time guiding the stream of product along a line of application.

British patent application No. 2015655 to Schumacker describes a dispenser for liquids and pastes in which there is provided a container having therein a piston, which is propelled by gaseous propellant, having first and second wall-engaging skirt portions and therebetween a number of wall-engaging scraper rings. Held between two adjacent scraper rings is an elastic or flexible ring made of foam. It is thought that such an arrangement would not provide a barrier of sufficient impenetrability to passage of propellant into the product to be dispensed.

An object of the present invention is to obviate or mitigate the aforesaid problems.

According to the present invention there is provided a dispenser for dispensing a product under pressure of a propellant including a container, a piston slidable in the container and dividing same into a product chamber for product to be dispensed and a propellant chamber, a flowable sealant material engaging the container wall and slidable with the piston, closure means for retaining propellant within the propellant chamber and a product outlet extending from the product chamber characterised in that the flowable sealant material comprises a liquid substance providing a substantially impenetrable barrier to the propellant.

Preferably the piston is a composite piston including a first wall-engaging surface and a second wall-engaging surface the wall-engaging flowable sealant material being located between said surfaces.

Preferably the composite piston comprises a primary piston having a wall-engaging skirt, a secondary piston having a wall-engaging skirt and between said pistons deformable sealant material whereby under pressure the deformable material is pressed between the pistons and urged against the container wall to form a seal.

Preferably also the primary piston is in frictional engagement with the wall and the secondary piston is in loose fit, thus to encourage pressing of the interposed deformable sealant material.

It is further preferred that the dispenser additionally includes a membranous partition wall within the propellant chamber and forming therein a propellant compartment.

The sealant material may be any liquid which is chemically compatible with the materials it will come into contact with in use. Water itself and water-based materials such as aqueous gel of alginic materials or gelatin are suitable, as are many organic and mineral oils, greases and waxes. Liquids such as ethylene glycol, diethylene glycol and glycerol are suitable for many applications. Many resinous and polymeric substances such as polyvinyl alcohol, silicones and acrylic resins can be used. Indeed, in general, any liquid can be used, subject only to their compatibility with the materials it will be in contact with, such as the propellant. Water and water-based gels are suitable for halocarbon propellants. To facilitate handling of the liquid sealant during manufacture and to assist in maintaining contact between sealant and piston so that they travel together, the liquid may be absorbed on to a solid filler material to form a flowable dough-like mass, formed into a gel or absorbed on a body of foamed plastics material.

The use of a liquid sealant is advantageous in that dents and other imperfections and the seams of seamed containers will be filled and smoothed out by the sealant as the pistons pass.

The invention will now be described, by way of example, with reference to the accompanying drawings of which FIG. 1 is a part-sectional perspective view of a dispenser of this invention;

Figure 1:
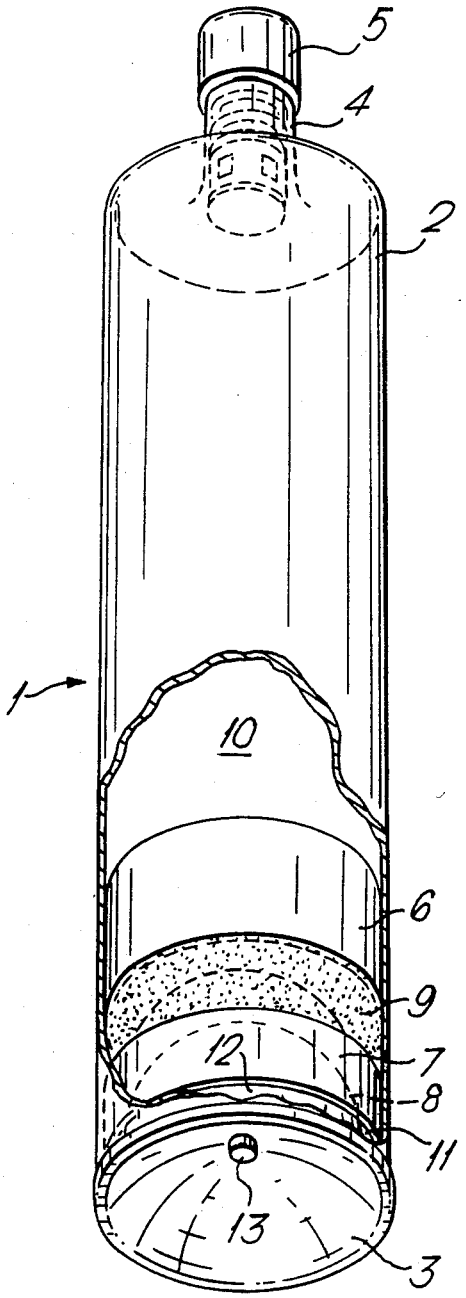
Figure 2:
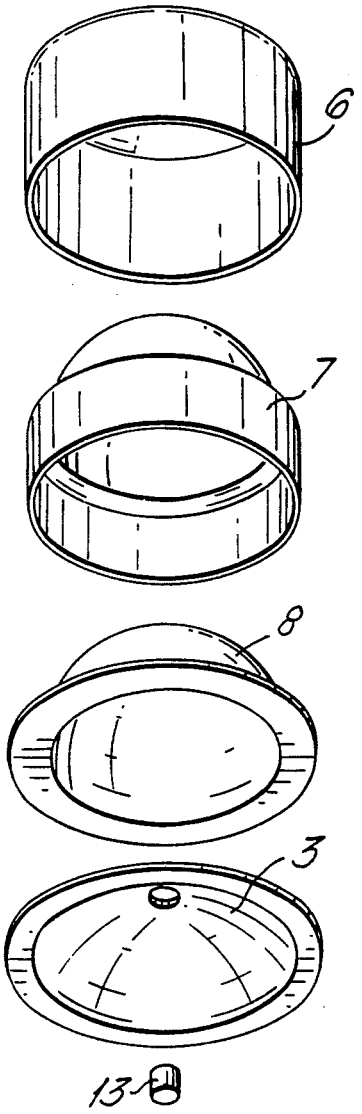
FIG. 2 is an exploded view of the pistons and membrane shown in FIG. 1.

Referring to FIGS. 1 and 2, a dispenser consists of an elongate cylindrical container 1 (which may be an extruded or a seamed can) having a top 2 and inturned domed base 3, the top having a neck 4 and fitted therein a valved outlet extrusion valve 5.

The precise details of the valve are not relevant to the invention described herein. It is sufficient for the purposes of the present invention that the design and dimensions of the valve and nozzle be such that will permit the product to be dispensed to exit via the valve. The design of the valve will be selected in accordance with, mainly, the viscosity of the product.

Within the container 1 there are, located serially from top to bottom, a primary piston 6, a secondary piston 7 and a membranous partition 8. Located between pistons 6 and 7 there is a mass of liquid sealant material 9. These parts divide the internal volume of the container into a chamber 10 for product to be dispensed and a chamber 11 for propellant. The presence of the membrane 8 is optional but, when present, it forms with the base 3 a propellant compartment 12. The base 3 has a generally central hole for introduction of propellant during filling after which it is closed by a plug 13. The crown of the primary piston 6 is shaped to conform generally to the internal configuration of the can top and internal parts of the valve 5 so as to maximise the amount of product which can be expelled by the piston.

Figure 3:
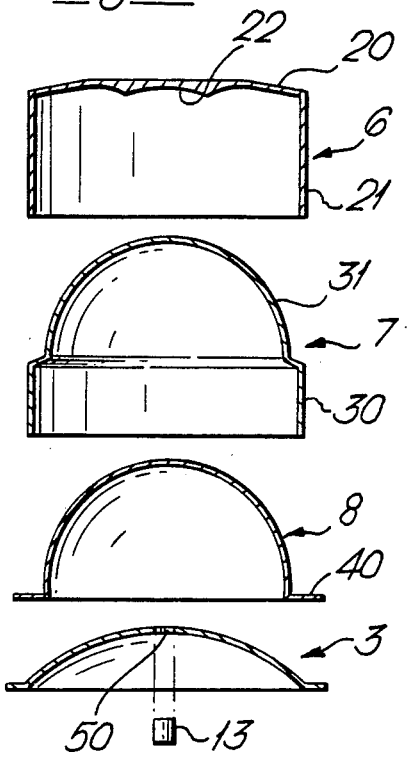
FIG. 3 is a cross-section through the parts shown in FIG. 2.

Referring to FIG. 3, the primary piston 6 has a slightly domed crown 20 and a wall-engaging skirt 21. There is formed in the piston 6 a domed recess 22, the purpose of which will be described later. Secondary piston 7 has a wall-engaging skirt 30 and a high-domed piston crown 31. Membrane 8 is a thin-walled film of nylon, domed in shape, with an outwardly-directed flange 40. The container base 3 is also of domed configuration and has central filling port 50 which is plugged by resilient plug 13.

It should be noted that when base 3 is crimped to the container the flange of the membrane 8 is folded into the crimped joint. The curvature of the dome of the base 3 and the membrane 8 are different so as to form therebetween a product compartment (12 in FIG. 1). The curvature of the membrane 8 and the dome of the secondary piston 7 are substantially the same. A body of deformable sealant is located between the pistons 6 and 7.

Figure 4:
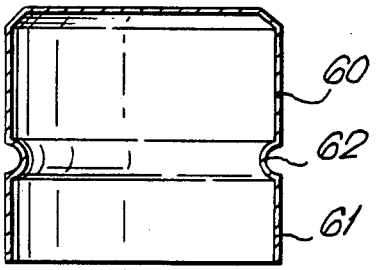
FIG. 4 is a cross-section of one alternative composite piston.

FIG. 4 illustrates one possible alternative form of composite piston. This is a single piston having a first wall-engaging surface 60, a second wall-engaging surface 61 with an annular recess 62 located between the surfaces 60 and 61 which is filled with the body of deformable sealant material.

The deformable sealant material 9 is preferably of a soft kneadable consistency or even a viscous liquid or a grease.

A brief description of the preferred method of filling and assembly of the dispenser will now be given.

Product is charged into the empty unturned container 1 which may be prior purged with inert gas. A primary piston 6 is then force fitted on the end of a ram, into the container 1. To facilitate insertion of the piston 6, the ram carries a dome-ended probe which is dimensioned to engage the domed recess 22 in the piston 6. The application of pressure on the centre of the piston causes the piston to flex permitting air or inert gas to escape past the piston leaving the product chamber free of gas. A body of the sealant 9 is then injected into the skirt of the piston 6, followed by insertion of the secondary piston 7 in a similar manner as for the primary piston 6 to which pressure is applied to force the sealant outwards against the container wall to form a seal. A flexible membrane 8 of domed shape with an out-turned annular lip is laid across the open end of the container and then the domed base 3 is crimped on to the container. The curvature of the base 3 and the membrane 8 are different so as to form a compartment 12 therebetween. Propellant is injected into the compartment 12 via its central aperture which is then closed by a plug 13. The curvature of the membrane 8 conforms to the curvature of the crown of the secondary piston 7 and is, at least initially, supported thereby.

The pack has a prolonged shelf life. Since the propellant is effectively encapsulated in the sealed compartment 12, the only possible manner in which the propellant can escape to deteriorate the product would be by molecular diffusion through the membrane itself. Even if diffusion occurred, or if the membrane was faulty and ruptured, any propellant present in chamber 11 would be contained therein by the double pistons and the sealant.

In use, the valve 5 is opened releasing the internal pressure, the propellant in chamber 12 expands thereby stretching the membrane 8 and forcing secondary piston 7 into even closer contact with the sealant 9 which is urged outward against the container wall. Primary piston 6 advances and extrudes the product from the valve. During continued use the membrane 8 eventually ruptures releasing propellant into chamber 11. Thus, the main purpose of membrane 8 is to prolong shelf life and the purpose of the sealant 9 is to prevent contact of propellant and product during use.

As the pistons 6 and 7 move along the container wall it is possible for sealant to be lost by passage into the product or propellant chambers if there is extensive damage in the form of longitudinal creases or dents in the container thus depleting the reservoir of sealant held between the pistons. If a large enough amount of the sealant is lost in this way the domed crown 31 of the secondary piston 7 comes into contact with the domed recess 22 of the primary piston 6 and the piston pair continue to move forward in physical engagement.

It is convenient to dimension the secondary piston 7 such that the capacity within its skirt and dome represent the ullage of the container.

It is preferred that the primary piston and the valve assembly be made of high density polyethylene such as RIGIDEX (Trade Mark) or of nylon the secondary piston of low density polyethylene and the membrane of thin film nylon.

I claim:

1. A dispenser for dispensing a product under pressure of a propellant, including a container, a piston slidable in the container and dividing same into a product chamber for product to be dispensed and a propellant chamber, a flowable sealant material engaging the container wall and slidable with the piston, closure means for retaining propellant within the propellant chamber and a product outlet extending from the product chamber characterised in that the flowable sealant material comprises a liquid substance providing a substantially impenetrable barrier to the propellant, the piston being a composite piston including a first wall-engaging surface and a second wall-engaging surface, the wall-engaging flowable sealant material being located between said surfaces, in which the composite piston comprises a primary piston having a wall-engaging skirt, a separate independently slidable secondary piston having a wall-engaging skirt and between said primary and said secondary pistons a (deformable) flowable sealant material whereby under pressure said (deformable) flowable material is (compressed) pressed between (the) said primary and secondary pistons and urged against the container wall to form a seal.

2. A dispenser as claimed in claim 1, in which the primary piston is in frictional engagement with the wall and the secondary piston is in loose fit thus to encourage pressing of the interposed flowable sealant material.

3. A dispenser as claimed in claim 1, in which the dispenser additionally includes a membranous partition wall within the propellant chamber and forming therein a propellant compartment adjacent the container base.

4. A dispenser as claimed in claim 1, in which the flowable sealant material is an aqueous gel.

5. A dispenser as claimed in claim 1, in which the flowable sealant material is an aqueous alginic gel.

6. A dispenser as claimed in claim 1, in which the flowable sealant material is gelatin.

7. A dispenser as claimed in claim 1, in which the flowable sealant material is a viscous organic oil.

8. A dispenser as claimed in claim 1, in which the flowable sealant material is mineral oil.

9. A dispenser as claimed in claim 1, in which the flowable sealant material is an organic grease.

10. A dispenser as claimed in claim 1, wherein the flowable sealant material is an organic liquid taken from the group consisting of ethylene glycol, diethylene glycol, and glycerol.

11. A dispenser for dispensing a product under pressure of a propellant including a container, a composite piston system slidable in the container and dividing same into a product chamber for product to be dispensed and a propellant chamber, a deformable sealant material engaging the container wall and slidable with the piston, closure means for retaining propellant within the propellant chamber and a product outlet extending from the product chamber in which the composite piston system comprises a primary piston in frictional engagement with the wall and having a wall-engaging skirt, a loose-fitting secondary piston having a wall-engaging skirt and between said pistons a deformable sealant material whereby under pressure said deformable material is pressed between the pistons and urged against the container wall to form a seal.

* * * * *